US012092427B2

(12) United States Patent
Kirsch

(10) Patent No.: US 12,092,427 B2
(45) Date of Patent: Sep. 17, 2024

(54) CUSTOMIZABLE LOCKING AND QUICK RELEASE MECHANISM AND KIT FOR HANDGUN HOLSTERS

(71) Applicant: Double-Alpha Academy B.V., Waalwijk (NL)

(72) Inventor: Saul J. Kirsch, Waalwijk (NL)

( * ) Notice: Subject to any disclaimer, the term of this patent is extended or adjusted under 35 U.S.C. 154(b) by 178 days.

(21) Appl. No.: 17/977,842

(22) Filed: Oct. 31, 2022

(65) Prior Publication Data

US 2024/0142197 A1 May 2, 2024

(51) Int. Cl.
*F41C 33/02* (2006.01)

(52) U.S. Cl.
CPC ..... *F41C 33/0263* (2013.01); *F41C 33/0245* (2013.01)

(58) Field of Classification Search
CPC ..... F41C 33/0245; F41C 33/0263
USPC ..... 224/244
See application file for complete search history.

(56) References Cited

U.S. PATENT DOCUMENTS

| | | | | |
|---|---|---|---|---|
| 1,750,139 | A | 3/1930 | Swift | |
| 1,951,865 | A | 3/1934 | Franz | |
| 2,349,376 | A | 5/1944 | Ray | |
| 4,277,007 | A | 7/1981 | Bianchi et al. | |
| 4,925,075 | A | 5/1990 | Rogers | |
| 5,372,288 | A | 12/1994 | Rogers et al. | |
| 5,467,909 | A | 11/1995 | Resca et al. | |
| 5,944,239 | A | 8/1999 | Rogers et al. | |
| 6,276,581 | B1 | 8/2001 | Glock | |
| 6,349,496 | B1 | 2/2002 | Neely | |
| 6,634,527 | B2 | 10/2003 | Liu | |
| 6,641,009 | B2 | 11/2003 | French et al. | |
| 6,732,891 | B2 | 5/2004 | Locklear, III | |
| 6,752,300 | B2 | 5/2004 | Har-Shen | |
| 6,769,581 | B2 | 8/2004 | Rogers et al. | |
| 7,556,181 | B2 | 7/2009 | Spielberger | |
| 8,720,754 | B2 | 5/2014 | Kirsch | |
| 10,247,514 | B2 * | 4/2019 | Chambers | F41C 33/0218 |
| 10,302,391 | B1 * | 5/2019 | Akar | F41C 33/045 |
| 10,436,550 | B2 * | 10/2019 | Lance | F41C 33/0254 |
| 10,502,523 | B1 * | 12/2019 | Chester | F41C 33/0263 |
| 10,563,952 | B2 * | 2/2020 | Tedder | F41C 33/0263 |

(Continued)

FOREIGN PATENT DOCUMENTS

| | | |
|---|---|---|
| EP | 3413009 | 12/2018 |

*Primary Examiner* — Peter N Helvey
(74) *Attorney, Agent, or Firm* — Whitley Legal Group, PC; AnnMarie W Whitley

(57) ABSTRACT

A customizable holster locking and quick release mechanism includes a holster body with interchangeable insert assemblies, interchangeable and optional spacers and shims, and adjustable and repositionable locking teeth for holding the trigger guard of multiple handgun models. The insert assembly attaches to the holster body and has an insert body with integral upper and lower body sections that support a slide lock rail having upper and lower rail sections. When assembled, the insert body and a side spacer create a receiving slot for a handgun trigger guard. The rail, guided by an angled track in the insert body, moves the locking teeth horizontally into and through the receiving slot as it displaces vertically in response to receiving a trigger guard. Magnets bias the rail depending on the presence of a handgun, encouraging the rail to lock the handgun in a lower position or release the handgun in an upper position.

20 Claims, 11 Drawing Sheets

(56) References Cited

U.S. PATENT DOCUMENTS

| | | | | |
|---|---|---|---|---|
| 10,619,974 | B2 * | 4/2020 | Smith | F41C 33/043 |
| 10,634,452 | B1 * | 4/2020 | Chester | F41C 33/0263 |
| 10,655,931 | B2 * | 5/2020 | Yeates | F41C 33/0236 |
| 10,900,744 | B1 * | 1/2021 | Houck | F41C 33/0209 |
| 10,996,024 | B2 * | 5/2021 | Smith | F41C 33/0236 |
| 11,098,979 | B2 * | 8/2021 | Hellweg | F41C 33/0227 |
| 11,415,388 | B2 * | 8/2022 | Su | F41C 33/0236 |
| 11,644,274 | B2 * | 5/2023 | Luna | F41C 33/0263<br>224/243 |
| 11,815,329 | B2 * | 11/2023 | Yeates | F41C 33/0236 |
| 2004/0050887 | A1 | 3/2004 | Spielberger | |

* cited by examiner

CUSTOMIZABLE LOCKING AND QUICK RELEASE MECHANISM AND KIT FOR HANDGUN HOLSTERS

FIELD OF THE INVENTION

The present invention relates to firearms and more specifically to a novel and useful improved customizable weapon retention mechanism with a quick release mechanism for handgun holsters.

BACKGROUND OF THE INVENTION

Two types of holster designs dominate the field of competition practical pistol shooting: muzzle support holsters and trigger guard gripping system holsters. Both types of holsters prevent the handgun from being inadvertently displaced (also known as "rocking forward" and "rocking backwards"), but many competition shooters prefer trigger guard systems. Because muzzle support systems rely on a handgun's muzzle to stabilize the handgun in the holster, they are considerably more bulky or clumsy than trigger guard systems. Because they are longer, muzzle support systems can press against a shooter's leg or thigh. Additionally, they can interfere with a shooter's position when kneeling or shooting prone.

Well known in the art, muzzle support holsters hold a handgun in two points: one point of support point is around the trigger guard, and a second point of support is at the muzzle. Because there are two support points, the trigger guard point of support is simplified, which is advantageous. The muzzle support point, however, is less desirable. To secure a handgun, the holster includes either a pin that protrudes into the muzzle area of the barrel or a cup for containing the slide and barrel around the muzzle area. Because they must fit a variety of barrel lengths without adjustment, muzzle support holsters are much larger and bulkier than those that rely on the trigger guard area only.

Holsters that grip the trigger guard without any muzzle support are also well known in the art. They support and secure a handgun only at the trigger guard so that most of the handgun is exposed. This type of holster design is compact and readily accommodates handguns having different barrel lengths without requiring any adjustments to the holster. Unfortunately, because this design relies only on the trigger guard area for support, holsters must be configured according to specification of the trigger guards of individual handgun models. In other words, a competition shooter must buy a separate holster for each of their handguns. Even then, handgun manufacturers do not consider treat the dimensions of the trigger guard as critical, which leads to small variances from one handgun to another despite being the same handgun model. Because adequate stability can be achieved only when the fit between trigger guard and holster lock is perfect, even a fraction of a millimeter difference can introduce play. As a result, trigger guard support systems typically allow a handgun to somewhat rock forward and backwards within the holster. This not only leads to the handgun falling out of the holster at some angles but also disadvantages the disadvantage to the competition shooter when rapidly drawing the handgun from the holster.

To prevent inadvertent displacement and decrease rocking, newer holsters include multiple locks and tension-control features. For example, the holster system described in U.S. Pat. No. 8,720,754, which is incorporated herein by reference, incorporates a sliding and locking assembly with teeth that receives a trigger guard and hold it in place with tension. The teeth lock the trigger guard as the handgun is seated in the holster, and the tension is adjustable depending on the type of draw a shooter prefers. A secondary lever system locks the sliding rail assembly in place to fully secure the handgun when needed. Unfortunately, as with all other trigger guard gripping systems, the specific configuration of the sliding and locking assembly and teeth required depends on the handgun to be holstered. Moreover, the overall holster size needed for stability and ease of use also varies across handgun models. Accordingly, holsters with a trigger guard gripping system must be made in many sizes, shapes, and configurations.

To accommodate a wide variety of handgun models and variances between trigger guard dimensions among each handgun model, a universal trigger guard gripping system is desired. It would be desirable to provide a kit with multiple spacers to customize the fit of the holster for a shooter's specific handgun. Additionally, it would be further desirable to include features allowing a shooter to position and adjust the configuration of the teeth on a sliding rail assembly.

BRIEF SUMMARY OF THE INVENTION

An improved holster locking and quick release mechanism and a kit for customizing the improved holster locking mechanism includes several interchangeable components and adjustable locking teeth. The includes a holster body that preferably also can be attached to a belt hanger or connector, an insert assembly, a side spacer, an optional side shim, an optional front spacer, and a plurality of fasteners for attaching the insert assembly, side spacer, side shim, and front spacer to the holster body or insert assembly as needed. Optionally, the kit can also include multiple interchangeable insert assemblies of varied sizes, multiple interchangeable front and side spacers and shims, and multiple interchangeable teeth.

Using the kit, a holster locking mechanism can be customized to cooperate with and secure the trigger guards associated with a wide variety of handgun models. The locking mechanism when assembled has a trigger guard receiving slot with which an upper tooth and lower tooth cooperate to hold or release a handgun's trigger guard. Together with and secured by a bent slide lock rail, upper tooth and lower form a slide lock rail assembly. The slide lock rail assembly translates along an angled track formed by a sloped surface in an insert block and a cooperating wedge secured in the insert block. Due to the angled track and bent rail, the teeth move laterally as they move vertically, which allows the upper tooth to extend in and out of a handgun's trigger guard depending on whether the handgun is being drawn or holstered.

When the holster locking mechanism is assembled optimally, the upper and lower teeth of the slide lock rail assembly fit snugly around a handgun's trigger guard, thereby holding the trigger guard in the holster locking mechanism when the slide lock rail assembly is positioned at a lower and locked position. The trigger guard is further discouraged from dislodging when the handgun is seated due to a pair of magnets positioned along the angled track and on the rail, which are oriented to repel one another. An additional safety lock assembly optionally further secures the trigger guard within the locking mechanism with a rotatable safety lever having a locking tip that extends into the trigger guard receiving slot and into a notch on the rail of the sliding rail assembly when the safety lever is engaged. When a shooter is ready to remove the handgun, the optional safety lock assembly can be easily disengaged with the rotatable safety lever. Then, the pair of magnets do not interfere as the shooter deliberately draws the handgun, easily overcoming their resistance. The slide lock rail is then free to move once initiated as friction is minimized, allowing a shooter to draw the handgun easily and smoothly. After the handgun is removed from the holster locking mechanism, the magnets maintain the slide lock reaches and remains at its fully top position until the handgun is re-holstered.

To build a holster locking mechanism using the kit, a shooter selects the insert assembly that best fits the trigger guard area of the handgun to be holstered. Next, the shooter aligns the trigger guard with the upper and lower teeth of the slide lock rail assembly in the insert assembly to adjust the position of the teeth along the rail, their distance from each other, and their rotation. The teeth are adjusted and rotated until they form an optimal fit with the trigger guard. If additional teeth are provided with the kit, the shooter can also exchange the upper and lower teeth for other teeth that have a shape that better cooperates with the trigger guard. After adjusting the teeth to match the shooter's handgun trigger guard, the shooter optimizes the overall fit of the insert assembly against the shooter's handgun using front and side spacers and optional shims. If any gap between the chosen insert assembly and the barrel of the handgun, the shooter also selects a front spacer. To create an optimally sized trigger guard receiving slot within the holster locking mechanism, the shooter also selects a side spacer and optional shim or shims that reduce the trigger guard receiving slot to the smallest size needed for the chosen handgun. Preferably, the shooter attaches the insert assembly, side spacer, and optional side shims to the holster body using the included fasteners. If needed, the shooter also attaches the front spacer to the insert assembly using additional included fasteners. Once fully assembled and after testing the build, the customized holster locking mechanism is ready for use, and the shooter can attach it to a shooting belt with a belt hanger or other connector.

The features and advantages of the present invention will be readily apparent to those skilled in the art upon a reading of the description of the exemplary embodiments, which follows.

Figure 1:
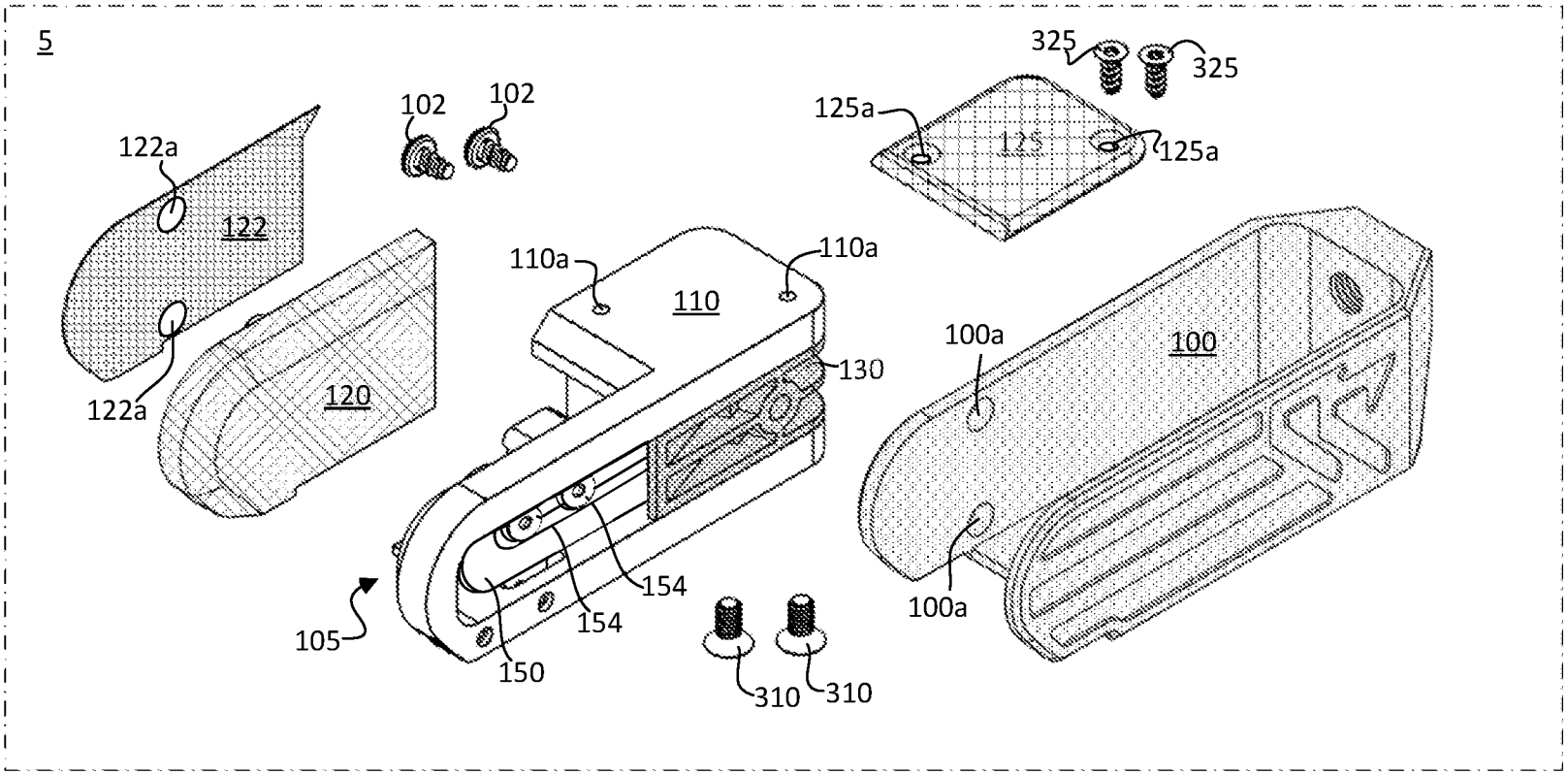
FIG. 1 is a perspective view of the components of a holster kit according to a preferred embodiment of the present invention.
Figure 2:
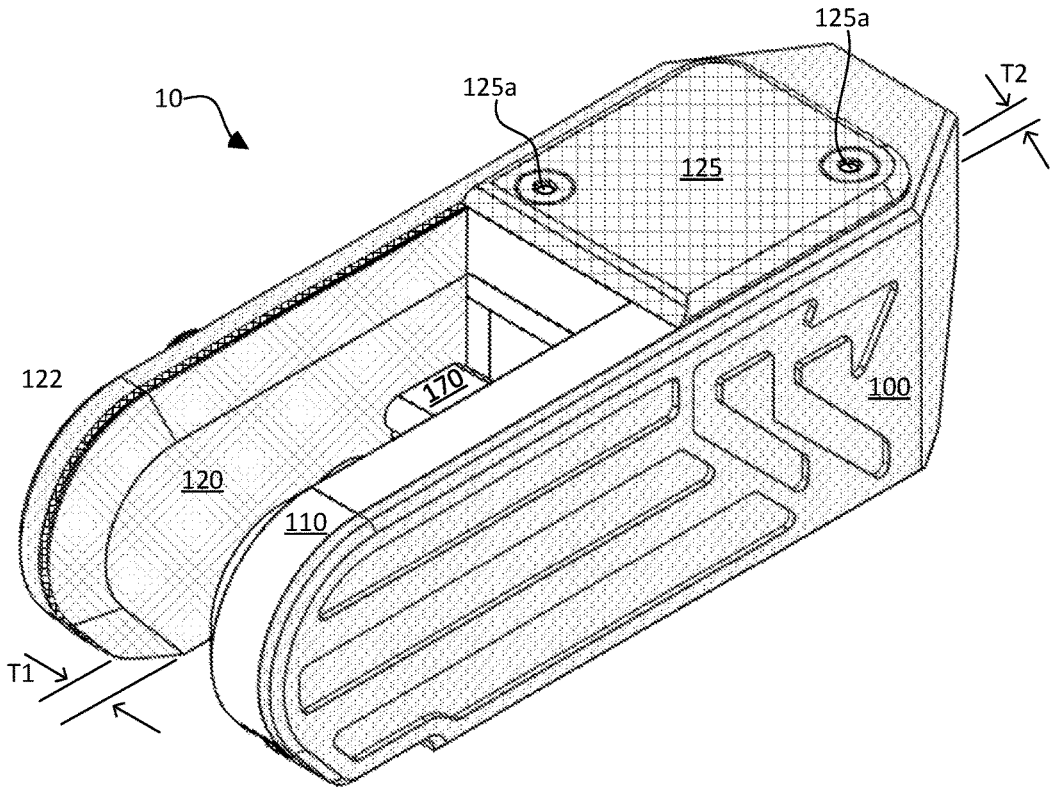
FIG. 2 is a perspective view of the holster locking mechanism according to a preferred embodiment of the present invention.
Figure 3:
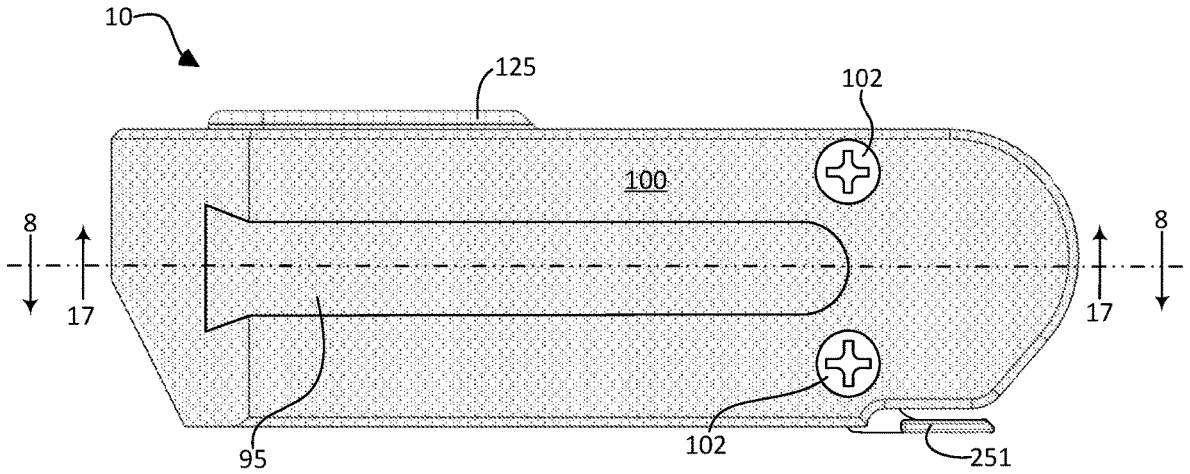
FIG. 3 is a first side view of the holster locking mechanism according to the preferred embodiment of the present invention.

For a better understanding of the invention reference is made to the following detailed description of the preferred embodiments of the invention which should be taken in conjunction with the above-described drawings.

DETAILED DESCRIPTION OF THE INVENTION

The present invention, as shown in FIGS. 1-28, relates to a novel and useful improved holster locking mechanism 10 and a kit 5 for customizing the improved holster locking mechanism. Kit 5 preferably includes the holster body 100, which is configured to optionally and preferably attach to a belt hanger or connector (not shown), an insert assembly 105, a side spacer 120, a side shim 122, a front spacer 125, and a plurality of fasteners 102, 310, and 325 for attaching the insert assembly 105, side spacer 120, side shim 122, and front spacer 125 to the holster body 100 or insert assembly 105 as needed. More preferably, kit 5 includes a first insert assembly 105 having a first size and a second insert assembly 105 having a second size, which is different from the first assembly's first size. Also in the preferred embodiment, a plurality of side spacers 120 are included, each having a different thickness T1, a plurality of identically sized side shims 122 are included, and a single or a plurality of front spacers 125 are included, each having a different thickness T2. For example, kit 5 preferably includes seven side spacers 120 having a thickness T1 that increases in 0.125 mm increments from a smallest thickness T1 of 2.50 mm to a largest thickness T1 of 10 mm, and one front spacer 125 having a thickness T2 of 2 mm.

Optionally, kit 5 includes replacement components for some or all the components of the kit. For example, kit 5 may include a plurality of upper teeth 160 and lower teeth 170 to use with insert assembly 105, where the teeth included have a variety of outer perimeters or shapes. Also optionally, individual components may be combined with or integral with other components. For example, insert assembly 105 may include a fixed side spacer 120, integrally formed therewith. Optionally, additional side spacers 120 may be combined with a fixed side spacer 120. All of kit 5 components are preferably made of a substantially rigid material such as plastic or metal.

As used to discuss the components and operation of holster locking mechanism 10, components may be divided into upper and lower sections or organized as upper and lower components. Likewise, parts or assemblies may move between upper and lower positions. Used herein, "upper" shall mean in a direction further from the ground when the holster locking mechanism is worn by a shooter, and "lower" shall mean in a direction closer to the ground when the holster locking mechanism is worn by the shooter. Similarly, "vertical" or "vertically" shall mean generally or substantially perpendicular to the ground, and "horizontal" or "horizontally" shall mean generally or substantially parallel to the ground. Vertically and horizontally shall also be understood to include orientations that are somewhat angled relative to a true vertical or a true horizontal as a shooter may prefer to orient their holster at an angle, the holster may rotate slightly when a handgun is seated therein, or the holster may be adjusted for other practical reasons.

Figure 4:
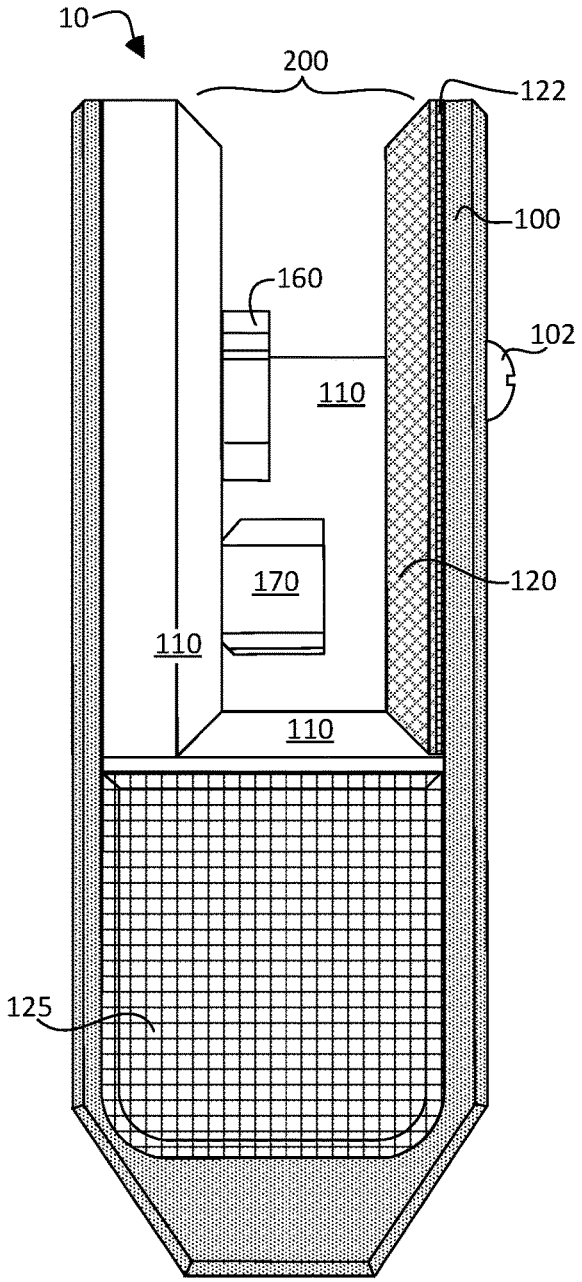
FIG. 4 is a second side view of the holster locking mechanism according to the preferred embodiment of the present invention.
Figure 5:
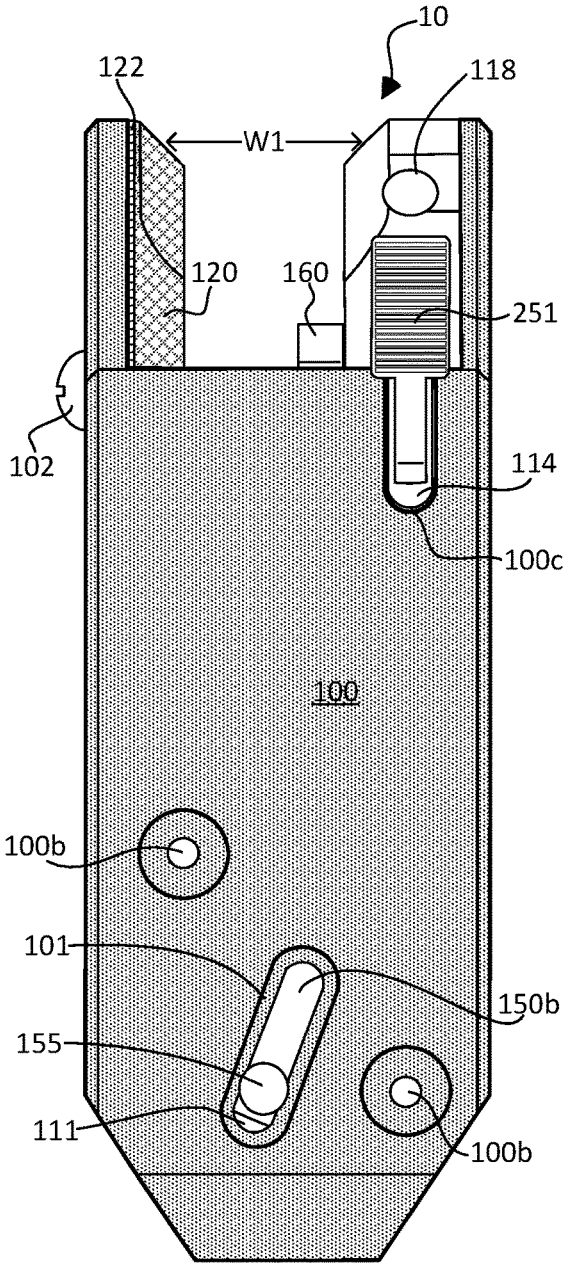
FIG. 5 is a third side view of the holster locking mechanism according to the preferred embodiment of the present invention.
Figure 6:
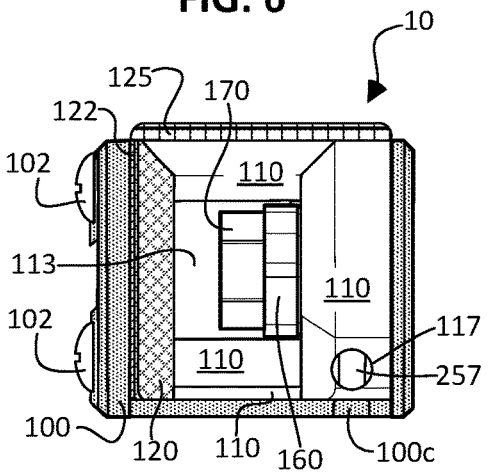
FIG. 6 is a first end view of the holster locking mechanism according to the preferred embodiment of the present invention.
Figure 7:
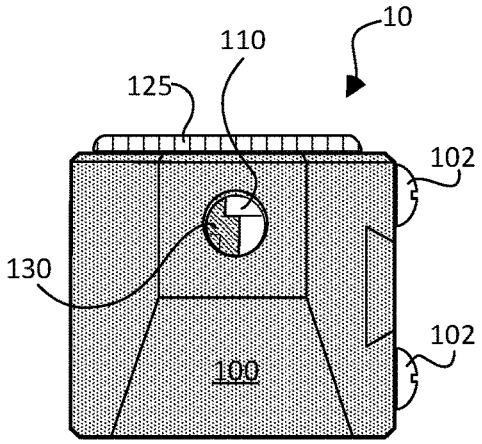
FIG. 7 is a second end view of the holster locking mechanism according to the preferred embodiment of the present invention.
Figure 21:
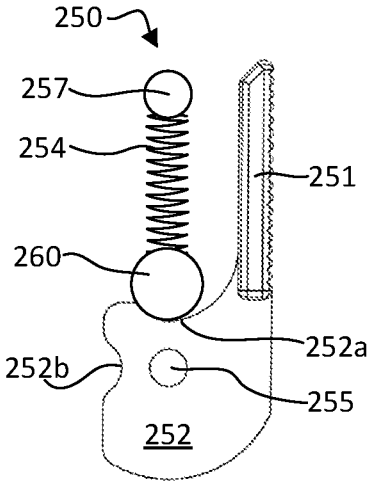
FIG. 21 is a first side view of the locking assembly according to the preferred embodiment of the present invention with the locking lever positioned in the unlocked position.
Figure 22:
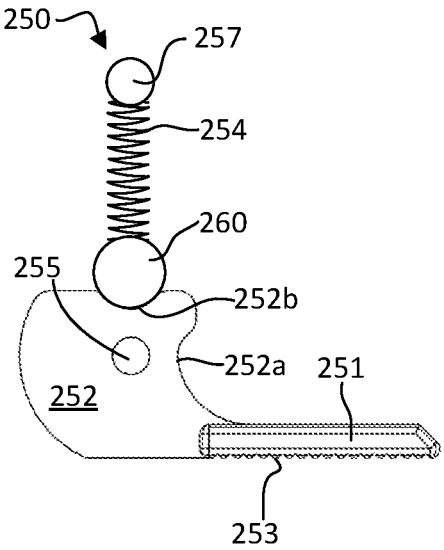
FIG. 22 is a first side view of the locking assembly according to the preferred embodiment of the present invention with the locking lever positioned in the locked position.
Figure 24:
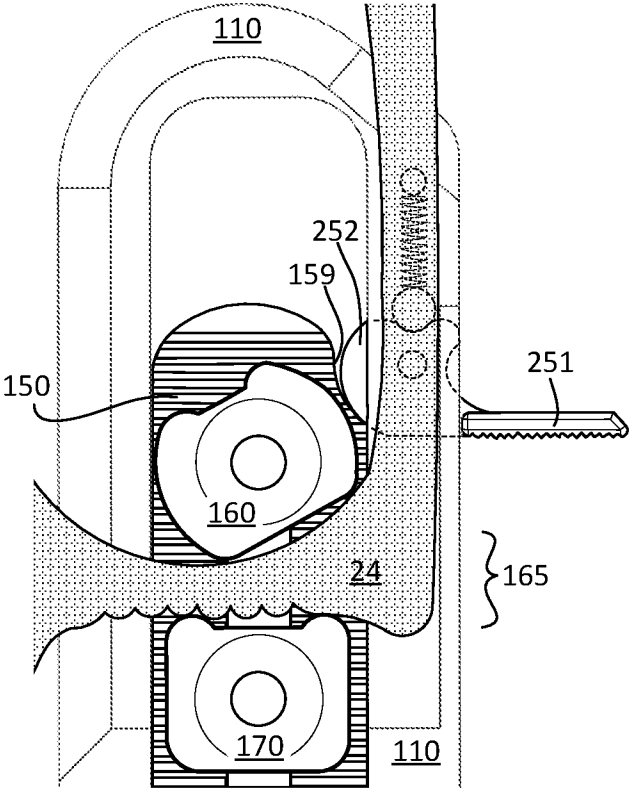
FIG. 24 is an illustration of a portion of the holster and gun trigger guard as viewed from the side according to the preferred embodiment of the present invention showing the locking lever positioned in the locked position.
Figure 23:
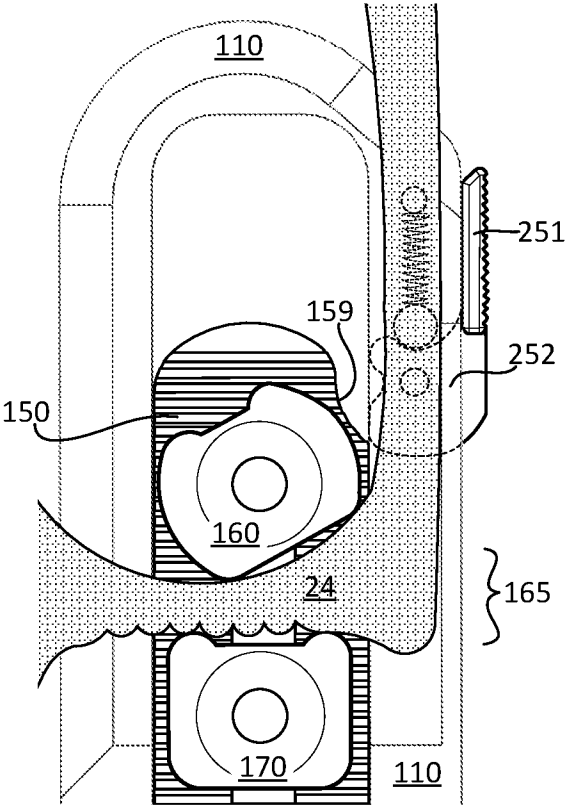
FIG. 23 is an illustration of a portion of the holster and gun trigger guard as viewed from the side according to the preferred embodiment of the present invention showing the locking lever positioned in the unlocked position.
Figure 25:
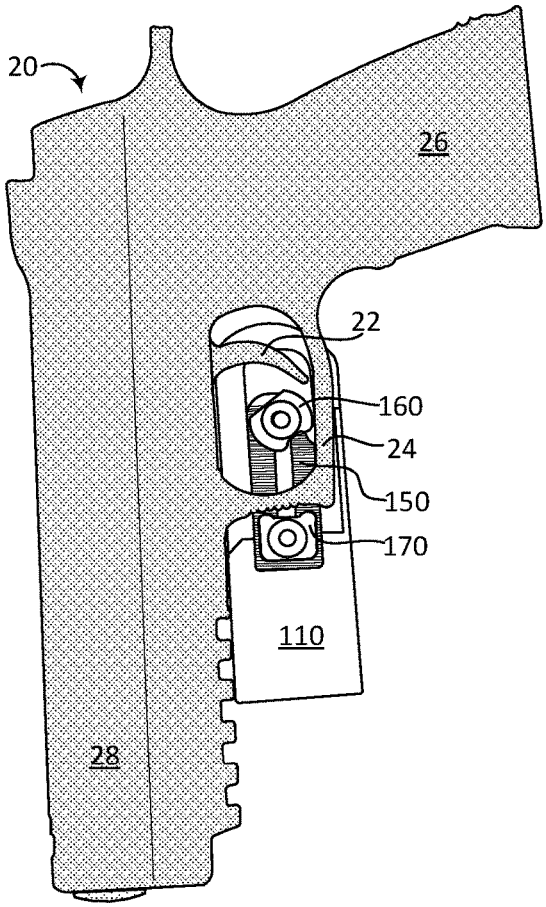
FIG. 25 is an illustration of a handgun positioned in an insert block of the holster locking mechanism of the present invention where no front spacer is needed.
Figure 26:
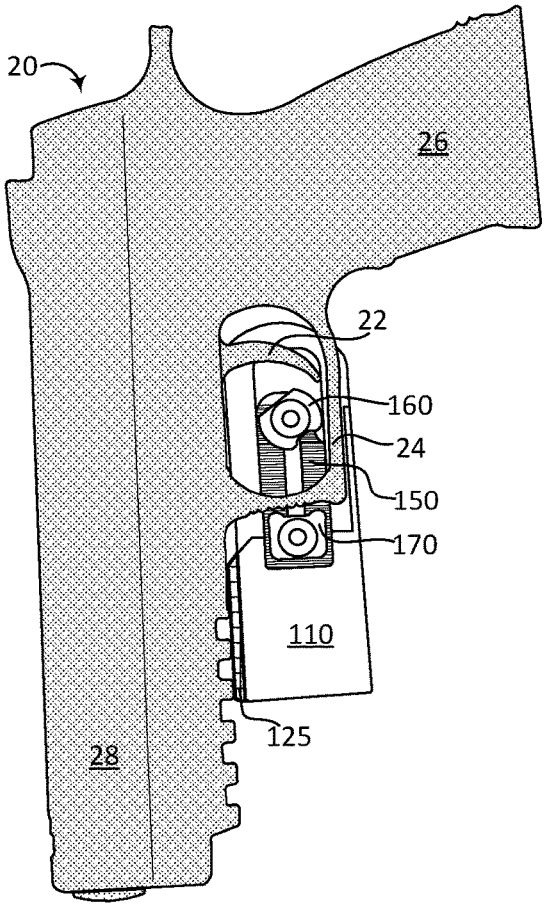
FIG. 26 is an illustration of a handgun positioned in an insert block of the holster locking mechanism according of the present invention where a front spacer is needed.
Figure 27:
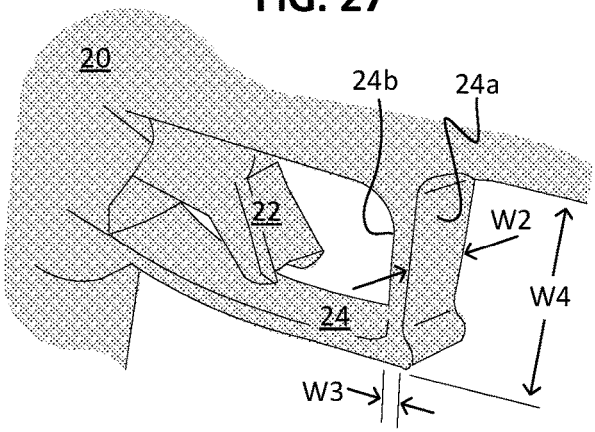
FIG. 27 is an illustration of the dimensions of a handgun trigger guard relevant to assembling the holster locking mechanism of the preferred embodiment of the present invention.

FIGS. 2-8 show an assembled improved holster locking mechanism 10 according to the preferred embodiment of the present invention, and FIG. 4 further illustrates how locking assembly 105 and side spacers 120 create trigger guard receiving slot 200, which is oriented vertically or somewhat vertically when in use by a shooter. When a gun 20, the parts of which are illustrated in FIGS. 25 and 26, is seated in holster locking mechanism 10, the handgun trigger guard 24 depresses a sliding rail assembly or slide lock rail assembly 140 of insert assembly 105. The components of insert assembly 105 and slide lock rail assembly 140 are further detailed in FIGS. 9-16, and FIGS. 17 and 18 illustrate the position of sliding rail assembly's 140 components when holster locking mechanism 10 is in a locked versus unlocked position. FIGS. 23 and 24 illustrate how teeth 160 and 170 of slide lock rail assembly 140 hold the trigger guard 24 in a locked position and further how the trigger guard can be further secured within the holster locking mechanism 10 by a safety lock assembly. FIGS. 19-22 also illustrate the features of the additional safety lock assembly. FIGS. 25-27 illustrate how to optimize the fit of holster locking mechanism 10 for a specific handgun model, and FIG. 28 details how a shooter assembles a holster locking mechanism 10 using kit 5 that is customized for the shooter's specific handgun 20.

Holster body 100 of holster locking mechanism 10 is preferably a housing configured to hold insert assembly 105, side shim 122, and side spacers 120 as shown in FIGS. 2-8. Holster body 100 preferably includes openings, slots, grooves, channels, or other structural features that allow for additional connections or facilitate its cooperation with the other components. Preferably, holster body 100 includes a structure 95 such as a channel, opening, or slot along an outside surface that is configured to cooperate with a belt hanger or other connector that facilitates attaching the holster locking mechanism 10 to a shooter's belt. Holster body 100 also preferably includes a slot 100*c* configured to accommodate a safety lever 251 or other safety lock assembly 250 components, a plurality of openings to support and provide access to safety lock assembly 250 components, and a plurality of openings that accommodate fasteners as described below. Optionally, holster body 100 is integrally formed with additional components of holster locking mechanism 10 such as the insert assembly 105, side spacers 120, or both.

Preferably, insert assembly 105 attaches to holster body 105 with fasteners 310. More preferably, fasteners 310 are threaded screws that cooperate with openings 110*b* of insert block 110 of insert assembly 105 through openings 100*b* of holster body 100. Openings 110*b* of insert block 110 optionally house threaded inserts (not shown) therein configured to cooperate with fasteners 310. Similarly, side spacers 120 and optional side shim 122 attach to holster body 105 with fasteners 102. More preferably, fasteners 102 are threaded screws that cooperate with openings 120*a* of spacers 120 through openings 100*a* of body 100 and openings 122*a* of optional side shim 122. Openings 1220*a* also optionally hold threaded inserts (not shown) therein configured to cooperate with fasteners 102.

Side spacers 120 and optional side shim 122 are configured to optimize the size of the slot 200 that receives a handgun's trigger guard 24. Preferably, one of a plurality of side spacers 120 of varying sizes is selected so that slot 200 is as narrow as possible yet still able to receive trigger guard 24. Optional side shim 122 can be inserted between side spacer 120 and holster body 100 to further narrow the trigger guard receiving slot 200 if needed. When an appropriate side spacer 120 and optional shim 122 are selected, the width W1 of trigger guard receiving slot 200 should be slightly wider than maximum width W2 of the trigger guard. Preferably, kit 5 includes a plurality of side spacers having a thickness T1 between 2.5 mm and 8.75 mm. Preferably, kit 5 further includes a side shim that is slimmer than the side spacer having the smallest width T1. For example, kit 5 may include seven side spacers 120 with thicknesses of 2.50 mm, 3.75 mm, 5.00 mm, 6.25 mm, 7.50 mm, 8.75 mm, and 10.00 mm and twelve side shims 122, each having a thickness of 0.12 mm. Multiple side shims 122 can be used together to bridge the gap between the provided side spacers 120.

Figure 8:
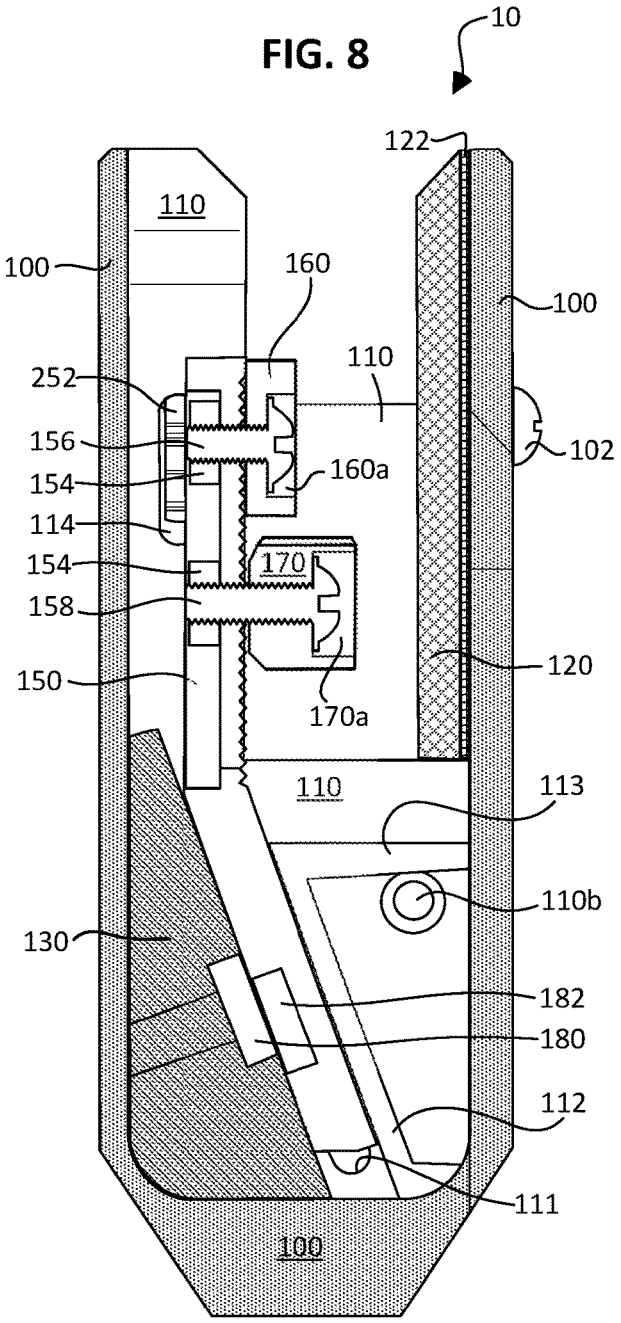
FIG. 8 is a cross section view of the holster locking mechanism according to the preferred embodiment of the present invention as cut along the line 8-8 shown in FIG. 3.
Figure 9:
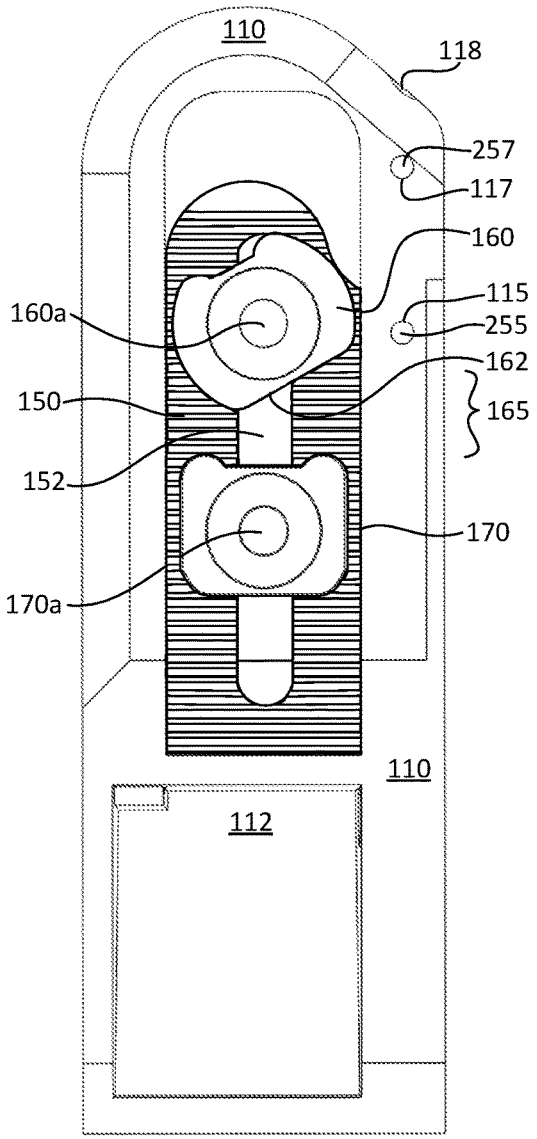
FIG. 9 is a first side view of the insert assembly according to the preferred embodiment of the present invention.
Figure 10:
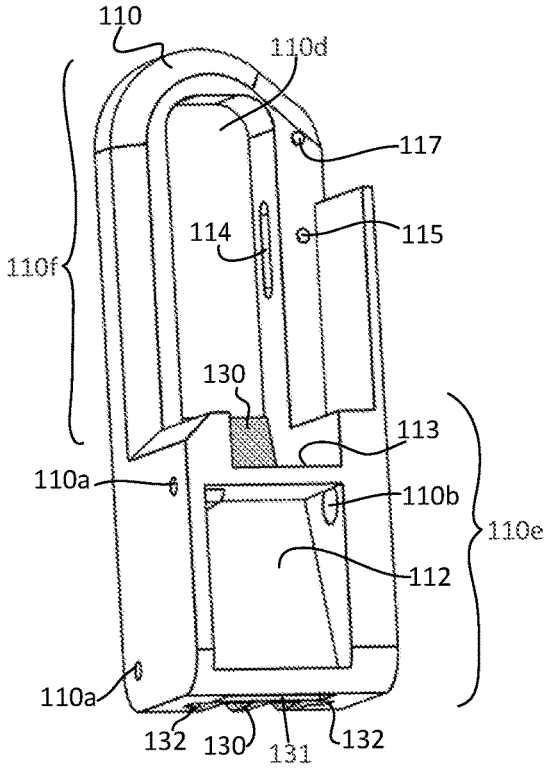
FIG. 10 is a perspective view of the insert block and wedge according to the preferred embodiment of the present invention.
Figure 11:
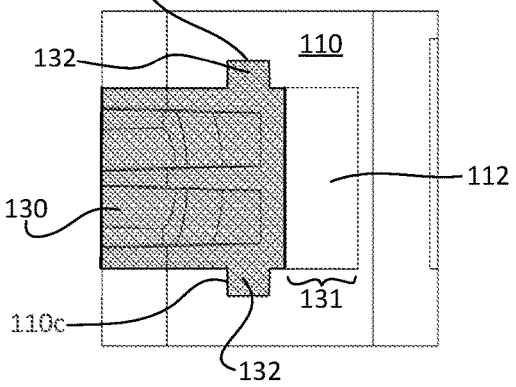
FIG. 11 is a first end view of the insert block and wedge according to the preferred embodiment of the present invention.
Figure 12:
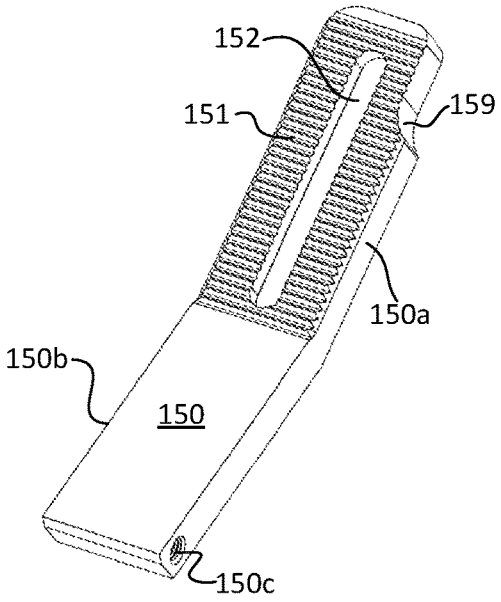
FIG. 12 is a perspective view of the slide lock rail according to the preferred embodiment of the present invention.

Insert assembly 105 includes insert body 110, wedge 130, and slide lock rail assembly 140, which are further detailed in FIGS. 9-11. Insert body 110 includes an upper section or insert frame section 110*f* and a lower section or track support section 110*d*, which are preferably integrally connected. Insert frame section 110*f* houses the safety lock assembly 250 components and defines an optional and preferred frame opening 110*d*. Insert track support section 110*e* includes a sloped surface 112 and an optional and preferred floor surface 113. Insert track support section 110*e* also houses or attaches to wedge 130, which is preferably removably attached to track support section 110*e* with wedge flanges 132 that cooperate with grooves 110*c* formed in the track support section 110*e* of insert body 110, as shown in FIG. 11. Optionally, wedge 130 is integrally formed with insert block 110 as part of track support section 110*e*. Whether attached to, housed within, or integrally formed with insert body track support section 110*e*, wedge 130 and sloped surface 112 of insert block 110 together define or form an angled track 131 between them. Angled track 131 is positioned relative to vertical at an angle of A1 as shown in FIG. 8 and generally slopes from an upper position near insert frame section 110*f* to a lower position within track support section 110*e*. Angled track 131 must be sized to accept a portion of slide lock rail assembly 140 and configured to allow slide lock rail assembly 140 to translate therein.

Preferably, attached to or housed within wedge 130 are bias components configured to encourage or discourage translation of slide lock rail assembly 140 in angled track 131, which is discussed further below. For example, bias components can be those that impact the tension between slide lock rail assembly 140 and track 131 or magnetic components oriented to create resistance to movement. In the preferred embodiment of the present invention, the bias components are magnetic, with wedge 130 housing a wedge magnet 180 positioned near angled track 131 through which a rail magnet 182 translates as part of slide lock rail assembly 140. Wedge magnet 180 and rail magnet 182 are preferably oriented to repel one another.

Figure 13:
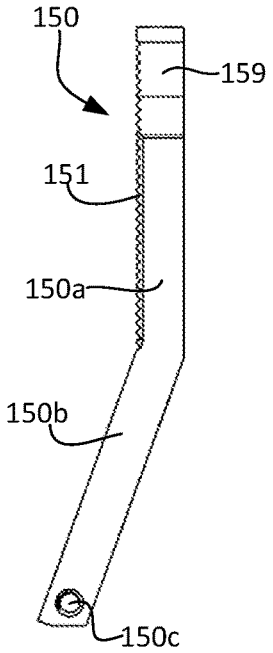
FIG. 13 is a first side view of the slide lock rail according to the preferred embodiment of the present invention.
Figure 14:
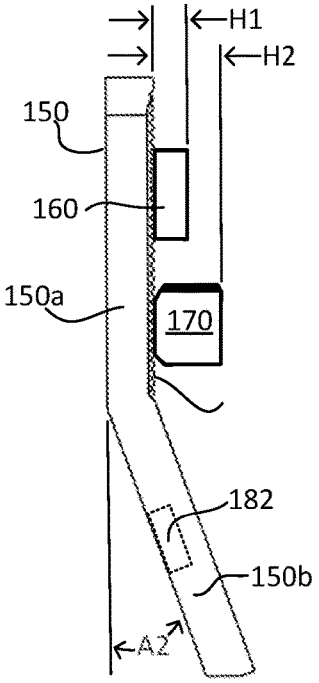
FIG. 14 is a second side view of the slide lock rail as it cooperates with the other slide lock rail assembly components according to the preferred embodiment of the present invention.
Figure 15:
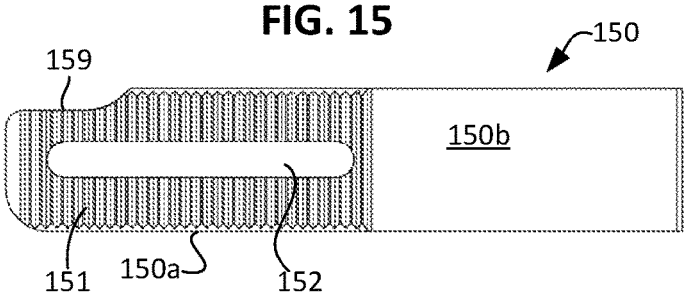
FIG. 15 is a third side view of the slide lock rail according to the preferred embodiment of the present invention.
Figure 16:
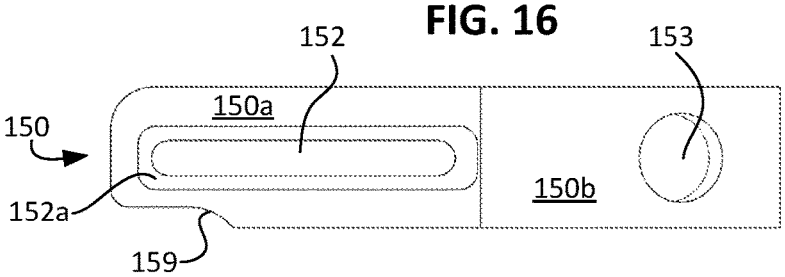
FIG. 16 is fourth side view of the slide lock rail according to the preferred embodiment of the present invention.

Slide lock rail assembly 140 is further illustrated in FIGS. 9 and 12-16. Slide lock rail assembly includes a slide lock rail 150 that includes an upper slotted section 150*a* defining a slot 152 and a locking notch 159 and an angled lower section 150*b*. Optionally, slot 152 along slotted section 150*a* may be replaced by or complimented with a series of openings, a series of notches, or any other configuration that provides a plurality of attachment points along slotted section 150*a*. Slotted section 150*a* is preferably integrally connected with angled lower section 150*b* such that angle A2 as shown in FIG. 13 is substantially the same as angle A1 shown in FIG. 8 between angled track 131 and frame section 110*f* of insert body 110. Preferably, angles A1 and A2 are between 15 and 45 degrees. More preferably, angles A1 and A2 are 20 degrees. Accordingly, when angled lower section 150*b* of rail 150 translates within angled track 131, slotted section 150*a* of rail 150 moves simultaneously both vertically and laterally.

Figure 18:
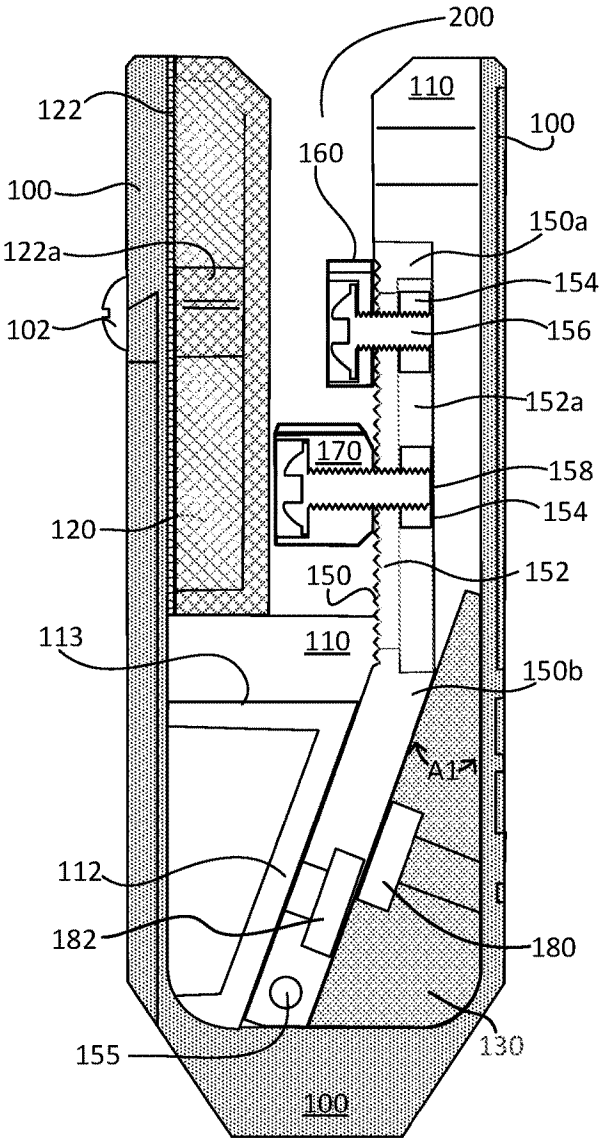
FIG. 18 is a cross section view of the holster locking mechanism according to the preferred embodiment of the present invention as cut along the line 17-17 shown in FIG. 3, the cross-section view illustrating a preferred position of the teeth and rail when in their lower position.
Figure 17:
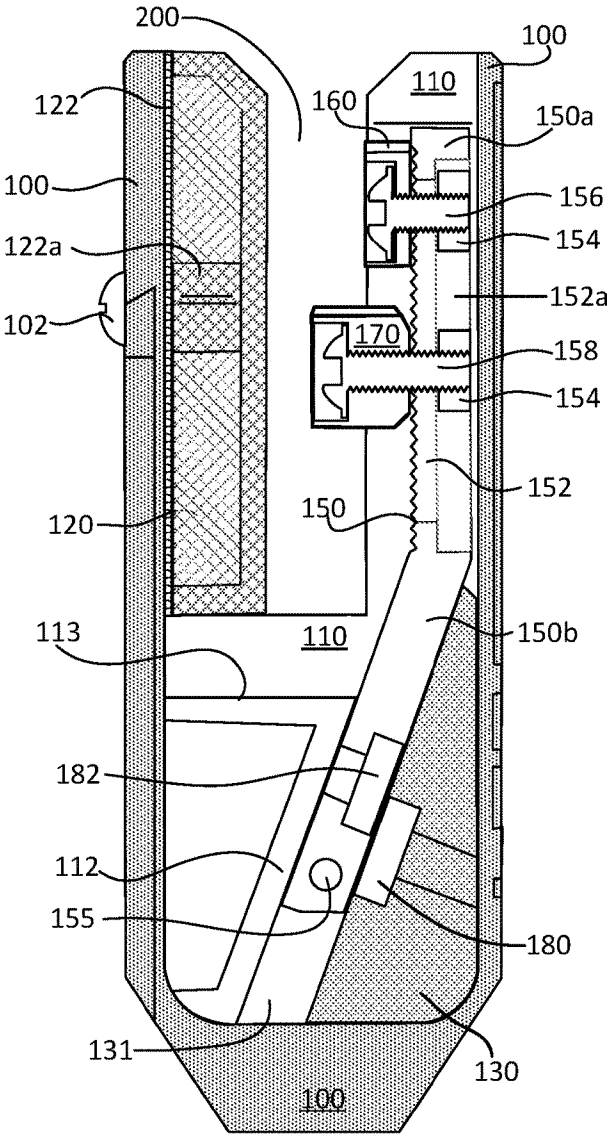
FIG. 17 is a cross section view of the holster locking mechanism according to the preferred embodiment of the present invention as cut along the line 17-17 shown in FIG. 3, the cross-section view illustrating a preferred position of the teeth and rail when in their upper position.
Figure 19:
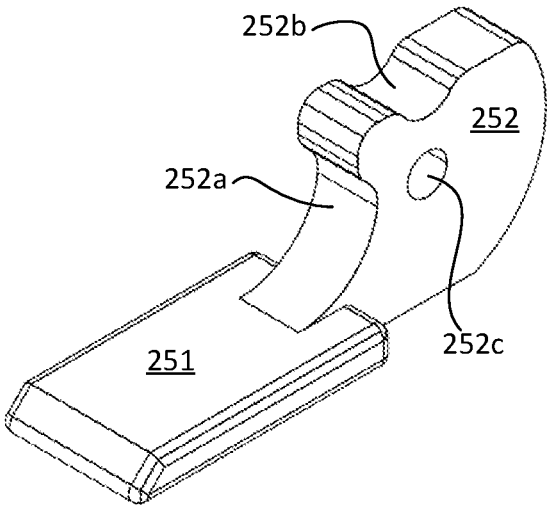
FIG. 19 is a perspective view of the locking lever according to the preferred embodiment of the present invention.
Figure 20:
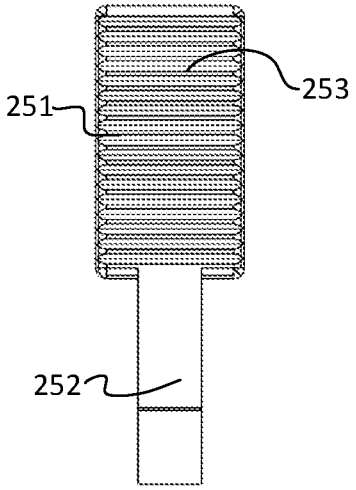
FIG. 20 is a first side view of the locking lever according to the preferred embodiment of the present invention.

Angled lower section 150*b* of rail 150 preferably further defines an opening 150*c* for a manual control pin, handle, lever, or knob 155 and a rail cavity 153 configured to accept and hold a rail magnet 182. Rail magnet 182 is positioned along lower section 150*b* such that wedge magnet 180 biases rail magnet 182 away from it to either a position above or below wedge magnet 180. Accordingly, rail 150 is encouraged to either be in a first unlocked or upper rail position as shown in FIG. 17 where rail magnet 182 is position above wedge magnet 180 or a second locked or lower rail position as shown in FIG. 18 where rail magnet 182 is positioned below wedge magnet 180. Manual control knob 155 extends from angled lower section 150*b* of rail 150 through a slot 111 in insert block 110 and a slot 101 in holster body 100 when holster locking mechanism 10 is fully assembled to allow a shooter to manually control movement of rail 150 if needed.

Slide lock rail assembly 140 further includes an upper tooth 160 and a lower tooth 170, which are preferably attached to rail 150 with fasteners disposed through slot 152 and optional slot fastener groove 152*a*. The upper section 150*a* of rail 150 extends along and near frame section 110*f* of insert block 110 as shown, and it shall be understood that "near" means within frame section 110*f*, immediately adjacent frame section 110*f*, and at a spaced distance from frame section 110*f* within the trigger guard receiving slot 200 formed by insert assembly 105 and side spacer 120. Upper tooth 160 and lower tooth 170 extend away from surface 151 of rail 150 in the direction of trigger guard receiving slot 200 and side spacers 120 when holster locking mechanism 10 is assembled. Surface 151 of rail 150 preferably has ridges, a rough surface, a gripping surface, or is otherwise configured to prevent teeth 160, 170 from slipping when they are positioned along and attached to rail 150. Each tooth 160, 170 preferably defines a channel or cavity 160*a*, 170*a* for receiving a fastener 156, 158 therethrough such as a threaded screw, which preferably is secured to a receiving fastener 154 such as a nut, sleeve, or cap as shown in FIGS. 17 and 18. Receiving fastener 154 preferably fits within slot fastener groove 152*a*. By loosening fasteners 156, 158, a shooter can reposition upper tooth 160 and lower tooth 170 along slot 152, adjust their orientation, and increase or decrease the size of a gap 165 between them. Optionally, upper and lower teeth 160, 170 can attach to rail 150 with fasteners that cooperate with notches, hooks, openings, or other receiving structures attached to or formed as part of upper rail section 150*a*.

Preferably, upper tooth 160 and lower tooth 170 are positioned along slot 152 such that the gap 165 formed between them cooperates with the width W3 of the trigger guard 24. More preferably, upper tooth 160 and lower tooth 170 also can be adjusted or rotated such that their outer perimeter aligns with the contours of trigger guard 24 to create a tight fit around the area of trigger guard 24 that is held between teeth 160 and 170. To that end, upper tooth 160 preferably has an irregular perimeter with a locking face 162 configured to facilitate its fit and cooperation with a variety of trigger guards. In some embodiments, kit 5 may include a plurality of interchangeable upper teeth 160 and a plurality of interchangeable lower teeth 170 with different perimeters so that a shooter can choose the optimal upper tooth 160 and lower tooth 170.

Upper tooth 160 has a height H1 that is smaller than the height H2 of lower tooth 170. Preferably, height H2 of lower tooth 170 is at least twice the thickness T3 of rail 150, and height H2 must be such that when rail assembly 140 and holster locking mechanism 10 are in the unlocked position as shown in FIG. 17, a portion of lower tooth 170 extends into trigger guard receiving slot 200. Conversely, height H1 of upper tooth 160 is preferably less than the thickness T3 of rail 150, and height H1 must be such that when rail assembly 140 and holster locking mechanism 10 are in the unlocked position as shown in FIG. 17, upper tooth 160 does not extend into trigger guard receiving slot 200. Preferably, height H2 of lower tooth 170 is less twice height H1 of upper tooth 160, and more preferably height H2 must not be so great that it prevents upper tooth 160 from fully extending into trigger guard receiving slot 200 when rail assembly 140 and holster locking mechanism 10 is in the locked position as shown in FIG. 18.

When assembled and customized by a shooter, holster locking mechanism 10 relies on slide lock rail assembly 140 to engage and lock within trigger guard 24 and thereby the shooter's handgun 20. How the rail 150 and slide lock rail assembly 140 move between a first unlocked upper position to a second locked lower position is shown in FIGS. 17 and 18. FIG. 17 illustrates the unlocked upper position of slide lock rail assembly 140, rail 150, upper tooth 160, and lower tooth 170, which occurs when no handgun 20 is seated in holster locking mechanism 10. FIG. 18 illustrates the locked lower position of slide lock rail assembly 140, rail 150, upper tooth 160, and lower tooth 170, which occurs when a handgun 20 is fully seated in holster locking mechanism 10.

As shown by FIGS. 17 and 18, when trigger guard 24 of handgun 20 is placed into trigger guard receiving slot 200 of holster locking mechanism 10, trigger guard 24 depresses lower tooth 170 of slide lock rail assembly 140 thereby displacing slide lock rail assembly 140 from the unlocked position to the locked position. When in the locked position, upper tooth 160 extends, projects, or protrudes into trigger guard 24. Preferably, the position and adjustment of upper tooth 160 is optimized such that it maximally cooperates with the contours specific to trigger guard 24 of the seated handgun 20 as described above. When in the unlocked position, upper tooth 160 retracts from trigger guard receiving slot 200 to facilitate removal of handgun 20. In other words, upper tooth 160 does not protrude into trigger guard receiving slot 200 until the presence of a trigger guard 24 causes it to do so.

The displacement of slide lock rail assembly 140 is guided or controlled by angled track 131 formed between wedge 130 and the sloped surface 112 of track support section 110*e* of insert block 110. Specifically, resistance from wedge 130 guides and controls slide lock rail assembly 140 as it moves along angled track 131 from the unlocked position (FIG. 17) to the locked position (FIG. 18), and resistance from sloped surface 112 of insert block 110 guides and controls slide lock rail assembly 140 as it moves in angled track 131 from the locked position (FIG. 18) to the unlocked position (FIG. 17). Preferably, lower tooth 170 is substantially transversely displaceable, in response to a handgun 20 being inserted into holster locking mechanism 10, and upper tooth 160 is transversely displaceable in response to a handgun 20 being displaced outwardly of holster locking mechanism 10.

Because track 131 is angled, as slide lock rail assembly 140 moves between the locked and unlocked positions, rail 150 and teeth 160, 170 move laterally as they move vertically. Thus, as a trigger guard 24 enters trigger guard receiving slot 200 and moves to seated position, it displaces lower tooth 170, creating a complimentary lateral displacement of upper tooth 160. Once the trigger guard 24 is fully seated in trigger receiving slot 200, which may correspond to when lower tooth 170 reaches the floor 112 of insert block 110, upper tooth 160 extends into trigger guard 24 thereby locking trigger guard 24 and handgun 20 in holster locking mechanism 10. FIGS. 23 and 24 illustrate how upper tooth 160 and lower tooth 170 engage trigger guard 24.

Resistance to inadvertent displacement of slide lock rail assembly 140 regardless of whether the holster locking mechanism 10 is in the locked lower or unlocked upper position is preferably achieved by the orientation and position of wedge magnet 180 and rail magnet 182. Preferably, wedge magnet 180 and rail magnet 182 are positioned such that they maximally overlap when slide lock rail assembly 140 is about halfway between its locked and unlocked positions. Wedge magnet 180 and rail magnet 182 are also preferably oriented such that they repel one another. The amount of force one must use to overcome the magnets depends on their strength. Using magnets provides the shooter with additional audible feedback when removing and holstering the handgun as they can make a click sound as the slide lock rail assembly 140 moves between its upper and lower positions. Further, using magnets ensures that the slide lock rail assembly reaches its maximum upper position when the handgun is removed, preventing upper tooth 160 from slipping to an intermediary position that could cause a trigger guard to snag it when re-holstering the handgun. Preferably magnets 180, 182 are fixed to wedge 130 and rail 150. Optionally, magnets 180, 182 can be replaced with stronger or weaker magnets should a shooter require additional customization.

While magnets are preferred for creating bias according to the present invention, other structures or features can be included to compliment the magnets or as a substitution for the magnets. For example, an adjustable tension screw and pressure pad assembly (not shown) can be substituted for the magnets where an adjustable draw is desired. The draw can be made heavier (more friction applied) or lighter (less friction applied) as desired by adjusting the amount of tension a screw and pressure pad apply to slide lock rail assembly 140.

Holster locking mechanism 10 optionally includes a safety lock assembly 250 for further resistance to handgun displacement when a handgun 20 is seated in the mechanism 10. As shown in FIGS. 19-24, safety lock assembly 250 is preferably housed within frame section 110*f* of insert block 110 at a location above the position of the upper tooth 160 and substantially aligned with rail notch 159 when the slide lock rail assembly 140 and holster locking mechanism 10 is in a locked position as shown in FIGS. 23 and 24. More preferably, safety lock assembly 250 is positioned in frame section 110*f* of insert block 110 such that a rotatable safety lever 251 cooperates with slot 114. Safety lever 251 preferably is pivotally supported by an axel 255 or other fulcrum or support that extends through a channel 252*c* in safety lever 251 and into openings 115 defined by frame section 110*f*. Slot 114 and openings 115 are shown in FIG. 10.

In addition to channel 252*c*, safety lever 251 includes a locking tip 252 with a first notch 252*a* and second notch 252*b* that each cooperate with a displaceable protrusion or ball 260. As shown in the Figures, displaceable ball 260 is preferably positioned immediately above safety lever 251 and vertically aligned with channel 252*c* and axel 255. A spring 254 or similar component positioned immediately above ball 260 biases ball 260 so that it rests in either first notch 252*a* or second notch 252*b* of safety lever 251. Spring 254 is held in place in frame section 110*f* of insert block 110 by anchor 257, which attaches at openings 117 in frame section 110*f*. Spring 254, ball 260, and anchor 257 can be accessed through an additional opening or access port 118 in frame section 110*f* of insert block 110.

Safety lock 251 clicks, springs, or otherwise moves between two positions. When ball 260 rests in first notch 252*a* as shown in FIG. 21, the safety lock is disengaged, and locking tip 252 is retracted in frame section 110*f* of insert block 110 through slot 114 as shown in FIG. 23. When ball 260 rests in second notch 252*a* as shown in FIG. 22, the safety lock is engaged, and locking tip 252 extends into trigger guard receiving slot 200 and rail notch 159 to prevent upward movement of rail 150 and upper tooth 160 as shown in FIG. 24. Spring 254 allows for slight vertical displacement of ball 260 as safety lever 251 moves between the locked and unlocked positions. Optionally, safety lever 251 further includes a slotted or grooved surface 253 to improve contact between a shooter's finger and safety lever 251 when safety lever 251 is disengaged.

To use the holster locking mechanism 10, a shooter attaches the holster locking mechanism 10 to a belt with a connector and positions the holster locking mechanism where comfortable. When ready to holster their handgun, a shooter lowers its trigger guard 24 into the trigger receiving slot 200, which faces upwards or away from the ground, and the outer edge of trigger guard 24 pushes lower tooth 170 down, overcoming any resistance created by magnets 180, 182. As lower tooth 170 descends, the angled track 130 translates any downward displacement of handgun 20 and slide lock rail assembly 140 into substantially transverse displacement of upper tooth 160 thereby exposing it within the trigger guard receiving slot 200. When the handgun 20 is fully lowered, upper tooth 160 extends far enough into trigger guard 24 to lock it in place and preferably magnets 180, 182 create sufficient resistance to prevent inadvertent displacement of handgun 20. To further secure handgun 24, the shooter can optionally engage the safety lock by pivoting lever 251 of the safety lock assembly 250 downwards, which causes lever locking tip 152 to extend into trigger guard receiving slot 200 at a position above upper tooth 160. Locking tip 152 prevents upper tooth 160 from moving upwards.

To remove the handgun 20, the shooter disengages the safety lock by pulling up on lever 250 of the safety lock assembly 250 provided the safety lock was engaged. Then the shooter pulls upward on handgun 20 so that the inner edge of the front of trigger guard 24 pulls upper tooth 160 of slide lock rail assembly 140 upwards, easily overcoming the resistance created from magnets 180, 182 for a quick release. Due to the specific angle of angled track 130, substantially upward displacement of the handgun 20 and slide lock rail assembly 140 is translated into a substantially transverse displacement of upper tooth 160. Thus, the trigger guard 24 is released as slide lock rail assembly 140 is substantially displaced, and upper tooth 160 no longer prevents trigger guard 24 from being released from trigger guard receiving slot 200. Once upper tooth 160 fully retracts from trigger guard receiving slot 200, the shooter can fully draw handgun 20 out of holster locking mechanism 10.

Figure 28:
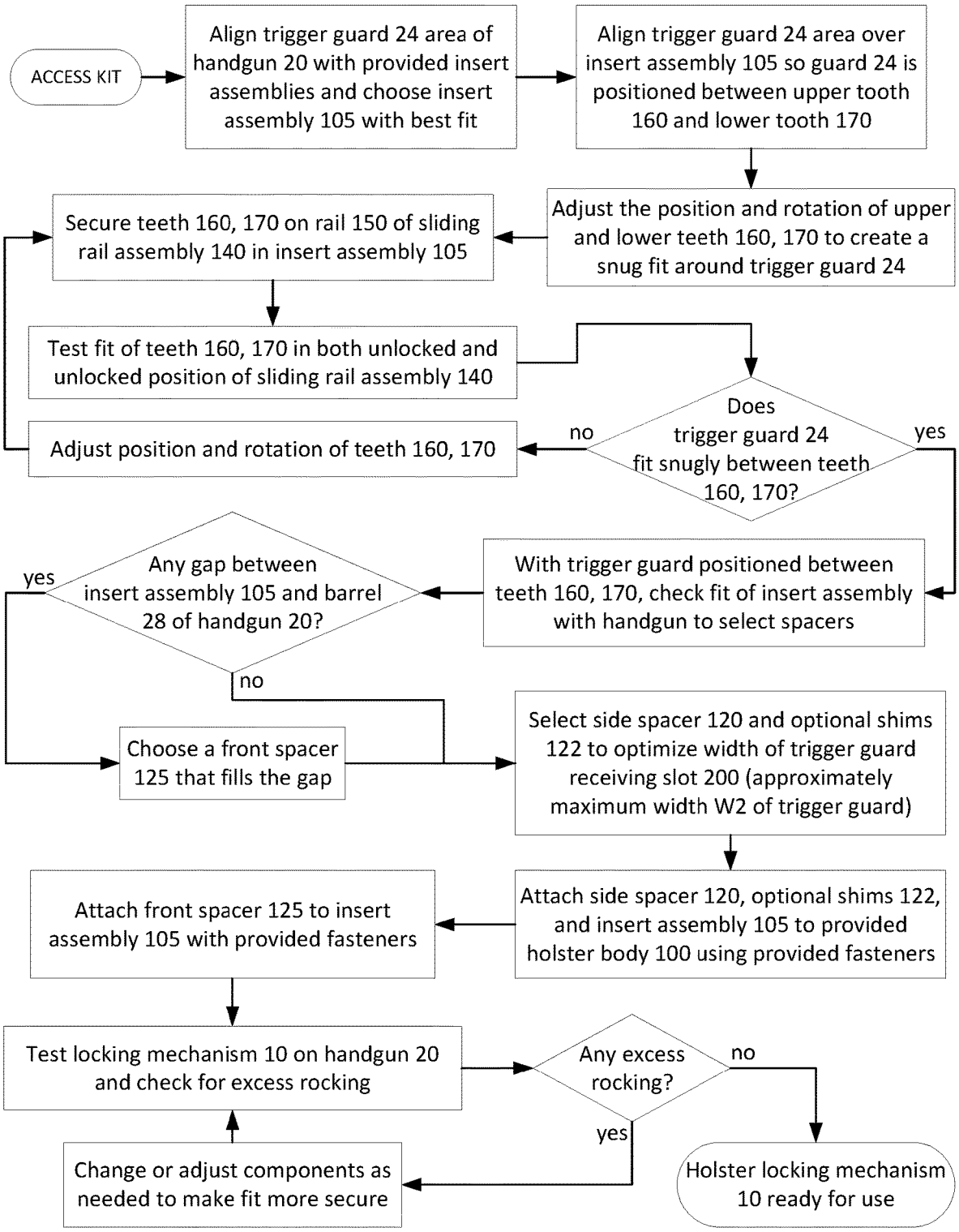
FIG. 28 is a flowchart illustrating how the holster locking mechanism is assembled using the kit according to the preferred embodiment of the present invention.

A shooter can customize their holster locking mechanism 10 using kit 5 as illustrated by FIG. 28. To do so, a shooter first adjusts and positions teeth 160, 170 where only one insert assembly 105 is provided with kit 5. Where multiple insert assemblies 105 of varied sizes are included with kit 5, a shooter first chooses the appropriate insert assembly 105 to use based largely on the width W4 of the trigger guard 24 area. By visually aligning the trigger guard area 24 with the available insert assemblies 105 in kit 5 or with a guide provided in kit 5, the shooter selects the insert assembly 105 that most closely matches width W4.

To adjust and position teeth 160, 170 on slide rail 150, the shooter aligns the trigger guard area over the insert assembly 105 so that the guard 24 is positioned between upper tooth 160 and lower tooth 170. The shooter then adjusts the position of the teeth 160, 170 along slot 152 of slide rail 150 so that gap 165 between them is minimized while being large enough to fit around trigger guard 24 as shown in FIGS. 23 and 24. The shooter optionally and preferably also rotates the teeth to optimize the contact between trigger guard 24 and the outer perimeter of teeth 160 and 170. Once the optimal position and rotation for teeth 160, 170 are determined, the shooter can tighten the fasteners 156, 158 so that upper tooth 160 and lower tooth 170 are secured in a fixed position. If additional teeth 160, 170 having different perimeters are included with kit, the shooter also should select the teeth 160, 170 that best cooperate with trigger guard 24. Next, the shooter should confirm that upper tooth 160 and lower tooth 170 are positioned along slot 152 such that they are correct in both the locked and unlocked position of the slide lock rail assembly 140. Before continuing to the next step, the shooter should make any further adjustments to teeth 160, 170.

Once teeth 160, 170 are adjusted and positioned, the shooter adjusts overall size of the insert assembly 105 with respect to the handgun 20 by selecting front and side spacers 125, 120 and optional shims 122. While the following steps recite choosing a front spacer 125 first and then a side spacer 120 and optional shims 122 second as further illustrated in FIG. 28, the order can be reversed if desired without changing the scope of the invention.

With the trigger guard 24 positioned between upper tooth 160 and lower tooth 170, if any gap is present between the insert assembly 105 and barrel area 28 of handgun 20, then a front spacer 125 having a thickness T2 that is equal to the size of the gap should be selected as well. FIG. 25 illustrates an insert assembly 105 and handgun 20 combination where no front spacer 125 is needed. FIG. 26 illustrates an insert assembly 105 and handgun 20 combination 20 where a front spacer 125 is appropriate.

Next, the shooter selects the appropriate side spacer 120 and optionally one or more shims 122 to add to the holster locking mechanism 10 based on how large of a trigger guard receiving slot 200 is needed. The size or width W1 of trigger guard receiving slot 200 roughly corresponds to maximum width W2 of trigger guard 24, and the spacer 120 and optional side shims 122 should be selected so that they fill the gap between the trigger guard receiving slot 200 and the holster body 100 when holster locking mechanism 10 is assembled.

After selecting the appropriate insert assembly 105, adjusting and positioning teeth 160, 170, and then selecting the appropriate side spacer 120, optional side shims 122, and optional front spacer 125, the holster locking mechanism 10 can be assembled. Insert assembly 105 is secured to holster body 100 with fasteners 310 through openings 100*b* and 110*b*, side spacer 120 and optional shim 122 are secured to holster body with fasteners 102 through openings 122*a* and 100*a*, and front spacer 125 is secured to insert assembly 105 through openings 110*a* and 125*a*.

Once the holster locking mechanism 10 is assembled, the shooter should test it and determine if any excess rocking should be addressed. Once the holster locking mechanism 10 meets the shooter's expectations, it can be attached to the shooter's belt with a belt hanger or other connector and is ready for use. Because the position and orientation of teeth 160, 170 can be adjusted and the size of the various components can be optimized, a holster locking mechanism 10 suitable for a wide variety of handgun classes can be built with the components of kit 5.

While in the foregoing, embodiments of the present invention have been set forth in considerable detail for the purposes of making a complete disclosure of the invention, it may be apparent to those of skill in the art that many changes may be made in such detail without departing from the spirit and principles of the invention.

I claim:

1. A customizable holster locking mechanism capable of cooperating with a variety of handgun models each having a trigger guard, the locking mechanism comprising:

a. a side spacer; and b. an insert assembly attached to the side spacer, the insert assembly comprising:

i. an insert block lower section defining an angled track, wherein the insert block lower section attaches to the side spacer;

ii. an insert block upper section integrally connected to the insert block lower section, wherein at least a portion of the insert block upper section is positioned at a spaced distance from the side spacer such that a receiving slot configured to receive at least a portion of a handgun trigger guard is defined by the side spacer and the insert block upper section;

iii. a rail comprising a lower rail section integrally connected at an angle to an upper rail section, wherein the upper section of the rail is disposed near the insert block upper section and the lower section of the rail is slidably disposed in the angled track such that it translates between an upper rail position and a lower rail position;

iv. an upper adjustable and repositionable tooth removably attached to the upper rail section of the rail, wherein the upper tooth is configured to retract into the insert body upper section when the rail is in the upper rail position, protrude into the receiving slot when the rail is in the lower rail position, and substantially cooperate with the trigger guard of the handgun when the trigger guard is placed in the receiving slot; and v. a bias assembly housed by the insert block lower section, wherein the bias assembly is configured to impact translation of the rail and to bias the rail to its upper rail position when the handgun trigger guard is absent from the receiving slot.

2. The customizable holster locking mechanism of claim 1 further comprising a holster body, wherein the insert block removably attaches to the holster body, the side spacer removably attaches to the holster body, and the insert block removably attaches to the side spacer through their mutual connection to the holster body.

3. The customizable holster locking mechanism of claim 2 further comprising a side shim, wherein the side shim removably attaches between the holster body and the side spacer.

4. The customizable holster locking mechanism of claim 2 further comprising a front spacer removably attached to the insert body lower section.

5. The customizable holster locking mechanism of claim 1 wherein the side spacer is integral with the insert block.

6. The customizable holster locking mechanism of claim 1 wherein the insert assembly further comprises a lower adjustable and repositionable tooth removably attached to the upper section of the rail and configured to protrude into the receiving slot when the rail is in its upper and lower rail positions.

7. The customizable holster locking mechanism of claim 1 wherein the bias assembly comprises a pair of magnets positioned and oriented to bias the rail to its lower rail position when the handgun trigger guard is seated in the receiving slot.

8. The customizable holster locking mechanism of claim 7 wherein the bias assembly comprises a first magnet disposed in the lower section of the rail and a second magnet disposed in the insert block lower section and oriented to repel the first magnet.

9. The customizable holster locking mechanism of claim 1 wherein the upper tooth is configured with an irregular perimeter and rotatable along an axis substantially perpendicular to the rail.

10. The customizable holster locking mechanism of claim 9 wherein the upper tooth is repositionable vertically along the upper rail section of the rail.

11. The customizable holster locking mechanism of claim 6 wherein the upper tooth is configured with an irregular perimeter and rotatable along an axis perpendicular to the rail and the lower tooth is configured with an irregular perimeter and rotatable along an axis perpendicular to the rail.

12. The customizable holster locking mechanism of claim 11 wherein the upper tooth and the lower tooth are repositionable vertically along the upper rail section of the rail.

13. The customizable holster locking mechanism of claim 12 further comprising a biased safety lever pivotally attached within the upper insert body, wherein the safety lever comprises a locking tip that selectively protrudes into a notch defined by the upper rail section of the rail.

14. The customizable holster locking mechanism of claim 8 wherein the insert assembly further comprises a wedge removably attached within the insert block lower section, wherein the wedge houses the second magnet and defines part of the angled track of the insert body lower section.

15. A customizable holster locking mechanism that cooperates with a variety of handgun models each having a trigger guard, the locking mechanism comprising:

a. a holster body;

b. a side spacer removably attachable to the holster body; and c. an insert assembly removable attachable to the holster body, the insert assembly comprising:

i. an insert block lower section defining an angled track, wherein the insert block lower section removably attaches to the holster body;

ii. an insert block upper section integrally connected to the insert block lower section, wherein a receiving slot configured to receive at least a portion of a trigger guard of the cooperating handguns is defined by the side spacer and the insert block upper section;

iii. a rail comprising a lower rail section integrally connected at an angle to an upper rail section, wherein the upper section of the rail is disposed near the trigger guard receiving slot and the lower section of the rail is slidably disposed in the angled track such that it translates between an upper rail position and a lower rail position;

iv. an upper adjustable and repositionable tooth removably attached to the upper rail section of the rail, wherein the upper tooth is configured to retract into the insert body upper section when the rail is in the upper rail position, protrude into the trigger guard receiving slot when the rail is in the lower rail position, and initiate displacement of the rail from its lower position to its upper position as the trigger guard is removed from the receiving slot;

v. a lower adjustable and repositionable tooth removably attached to the upper rail section of the rail at a spaced distance below the upper tooth, wherein the lower tooth is configured to protrude into the trigger guard receiving slot and initiate displacement of the rail from its upper position to its lower position as the trigger guard is placed in the receiving slot; and vi. a bias assembly housed by the insert block lower section, wherein the bias assembly is configured to bias the rail to its upper rail position when the handgun trigger guard is absent from the receiving slot and to its lower rail position when the handgun trigger guard is seated in the receiving slot.

16. The customizable holster locking mechanism of claim 15 wherein the bias assembly comprises a first magnet disposed in the lower section of the rail and a second magnet disposed in the insert block lower section, the first and second magnets being oriented to repel one another.

17. The customizable holster locking mechanism of claim 15 wherein:

a. the upper tooth is configured with an irregular perimeter, rotatable along an axis perpendicular to the rail, and vertically repositionable along the upper rail section of the rail;

b. the lower tooth is configured with an irregular perimeter, rotatable along an axis perpendicular to the rail, and vertically repositionable along the upper rail section of the rail; and c. the upper tooth and the lower tooth are adjustable and repositionable such that they can hold a portion of the trigger guard in the spaced distance between the upper adjustable tooth and the lower adjustable tooth when the handgun trigger guard is seated in the receiving slot.

18. A custom locking holster mechanism kit that cooperates with a variety of handgun models each having a trigger guard, the kit comprising:

a. a holster body;

b. a plurality of side spacers of varying thicknesses configured to removably attach to the holster body;

c. an insert assembly configured to removably attach to the holster body, the insert assembly comprising:

i. an insert block lower section defining an angled track, wherein the insert block lower section is configured to removably attach to the holster body;

ii. an insert block upper section integrally connected to the insert block lower section, wherein a receiving slot configured to receive at least a portion of a trigger guard of the cooperating handguns is defined by the side spacer and the insert block upper section when any of the side spacers and the insert block are attached to the holster body;

iii. a rail comprising a lower rail section integrally connected at an angle to an upper rail section, wherein the upper section of the rail is disposed near the trigger guard receiving slot when the insert assembly is attached to the holster body and the lower section of the rail is slidably disposed in the angled track such that it translates between an upper rail position and a lower rail position;

iv. an upper adjustable and repositionable tooth removably attached to the upper rail section of the rail, wherein the upper tooth is configured to retract into the insert body upper section when the rail is in the upper rail position, protrude out from the insert body upper section when the rail is in the lower rail position;

v. a lower adjustable and repositionable tooth removably attached to the upper rail section of the rail at a spaced distance below the upper adjustable and repositionable tooth, wherein the lower tooth is configured to protrude out from the insert body upper section; and vi. a bias assembly housed by the insert block lower section, wherein the bias assembly is configured to bias the rail to its upper rail position or its lower rail position depending on whether a handgun trigger guard is seated in the receiving slot when the insert assembly is attached to the holster body; and d. a front spacer configured to removably attach to the insert assembly.

19. The customizable holster locking mechanism kit of claim 16 further comprising a plurality of interchangeable insert assemblies of varying sizes.

20. The customizable holster locking mechanism kit of claim 16 wherein:

a. the upper tooth of the insert assembly is configured with an irregular perimeter, rotatable along an axis perpendicular to the rail, and vertically repositionable along the upper rail section of the rail;

b. the lower tooth of the insert assembly is configured with an irregular perimeter, rotatable along an axis perpendicular to the rail, and vertically repositionable along the upper rail section of the rail; and c. the upper adjustable and repositionable tooth and the lower adjustable and repositionable tooth are capable of being adjusted and repositioned to hold a portion of the trigger guard of each of the variety of handguns within the spaced distance between the upper tooth and the lower tooth when the holster locking mechanism is assembled and the trigger guard is seated in the receiving slot.

* * * * *